US008491274B2

(12) United States Patent
Taylor et al.

(10) Patent No.: US 8,491,274 B2
(45) Date of Patent: Jul. 23, 2013

(54) SYSTEM FOR OPERATING AN AIR CONDITIONING COMPRESSOR FROM ALTERNATIVE SOURCES

(76) Inventors: Richard D Taylor, Kansas City, KS (US); Paul E Harris, Kansas City, KS (US)

( * ) Notice: Subject to any disclaimer, the term of this patent is extended or adjusted under 35 U.S.C. 154(b) by 975 days.

(21) Appl. No.: 12/563,715

(22) Filed: Sep. 21, 2009

(65) Prior Publication Data

US 2011/0067425 A1 Mar. 24, 2011

(51) Int. Cl.
*F04B 49/00* (2006.01)
*F04B 9/14* (2006.01)
*F25B 27/00* (2006.01)

(52) U.S. Cl.
USPC ..... 417/223; 417/374; 62/236; 62/323.4; 192/48.2

(58) Field of Classification Search
USPC ..... 417/223, 374; 62/236, 323.3, 323.4; 192/48.2, 84.961
See application file for complete search history.

(56) References Cited

U.S. PATENT DOCUMENTS

| | | | | |
|---|---|---|---|---|
| 2,150,276 | A * | 3/1939 | Gorman | 62/236 |
| 3,017,977 | A * | 1/1962 | Settimi | 192/48.8 |
| 3,429,192 | A * | 2/1969 | Allen | 474/70 |
| 384,287 | A | 10/1974 | Pierce | |
| 4,531,379 | A * | 7/1985 | Diefenthaler, Jr. | 62/236 |
| 5,909,075 | A * | 6/1999 | Heimark | 310/103 |
| 619,939 | A1 | 3/2001 | Link | |
| 6,796,367 | B2 * | 9/2004 | Blacquiere et al. | 165/41 |
| 681,258 | A1 | 11/2004 | Kennedy | |
| 6,812,582 | B2 * | 11/2004 | Kennedy | 290/1 A |
| 7,104,765 | B2 * | 9/2006 | Miyaji et al. | 417/223 |

* cited by examiner

*Primary Examiner* — Charles Freay
(74) *Attorney, Agent, or Firm* — David E Herron, II

(57) ABSTRACT

The disclosure describes a system for operating an air conditioning compressor from alternative sources. The system includes primary and secondary torque supply sources, each in communication with the input shaft of an air conditioning compressor by first and second respective pulley belts.

13 Claims, 6 Drawing Sheets

SYSTEM FOR OPERATING AN AIR CONDITIONING COMPRESSOR FROM ALTERNATIVE SOURCES

BACKGROUND OF THE INVENTION

Traditionally, an operator of an automobile that desired the comfort of air-conditioning within the cabin of the automobile required one to run the engine in order to have air conditioning. Indeed, the traditional method of providing input torque to the air conditioning compressor was by transmitting power from the automobile's engine. Consequently, running (or idling) the engine was generally required in order to enjoy the comfort of air conditioning. Conversely, air condition was traditionally unavailable when the engine was not running.

The invention disclosed addresses this problem with the traditional state of the art. The inventive system incorporates an alternate means for providing power to activate a standard automotive air conditioning unit.

SUMMARY OF THE INVENTION

The invention is a system for operating a mounted automobile air conditioning compressor from alternative sources. The system will include a primary torque supplying source and a secondary torque supplying source. The system also requires an air conditioning compressor having a rotatable input compressor shaft, and a coil mounted to the compressor so that it encircles the compressor shaft.

Additionally, the invention also includes a means for inducing current within the coil. Running current through the coil creates an energized state whereby a magnetic field is emitted from the coil. Preferably, an ultra-high magnetic attraction is created.

Moreover, the inventive system will include a pair of sheaves, each mounted to the rotatable input shaft of the compressor. The first sheave is axially mounted about the rotatable compressor shaft to enable rotation of the first sheave relative the compressor shaft. The second sheave is affixed to the rotatable input compressor shaft in such a way to prohibit rotation of the second sheave relative the compressor shaft. In short, turning the one (second sheave or shaft) also turns the other. Analogously, the second sheave will also have a second groove formed on a radial surface of the second sheave.

A first pulley belt engages the first sheave; this transmits rotation from the primary torque supplying source to the first sheave. Analogously, a second pulley belt engages the second sheave, and consequently imparts torque to the compressor shaft.

The system also includes a deformable gap positioned between the first sheave and second sheaves when the coil is in a de-energized state. However, when the coil is in the energized state (by running current through it), the magnetic field biases a clutch plate of the second sheave into frictional engagement with the first sheave to impart rotating torque to the compressor shaft.

When the coil is in the non-energized state, the first sheave may rotate freely about the compressor shaft. Thus, if the primary torque supply source is transmitting rotation via the first pulley belt, the first sheave might "spin" about the stationary input compressor shaft. However, when the coil is energized, the first clutch plate attached to the second sheave is pulled into frictional engagement with the first sheave, thereby causing the second sheave to rotate along with the first, which in turn imparts rotating torque to the input compressor shaft.

In a preferred embodiment, the first magnetic coil includes a hollow portion radially encompassing the hub of the first sheave. The coil and hollow portion are cooperatively formed so that the coil fits loosely within the hollow portion.

Preferably, the primary source includes an internal combustion engine, of course, a standard diesel engine with an auxiliary power shaft works well within the inventive system. Additionally, the secondary torque source may include a battery powered DC electric motor, an AC motor powered by a AC/DC inverter, or even a small internal combustion engine.

In a preferred embodiment of the invention, a switch enables the current source to selectively induce the magnetic field, and thereby activate the clutching mechanism that will turn both sheaves. Of course, the switch should be activatable from the interior of the automobile.

Further, the system may also include a gate switch for placing the coil in the de-energized state upon activation of the secondary torque source. indeed, if the secondary torque source is imparting rotation to the input compressor shaft, it is important that the first sheave be left to freewheel about the input compressor shaft to avoid an undue load on the secondary torque source.

The secondary source preferably derives its power from a power source independent of the engine, such as a motor generator, battery pack or the like. Generally, the secondary torque source will also include a shaft of its own, and at least one sheave mounted to this shaft and positioned to engage a second pulley. In a preferred embodiment, a clutch means is coupled to the sheaves; preferably a double clutching mechanism that includes a respective magnetic coil in cooperation with each sheave.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
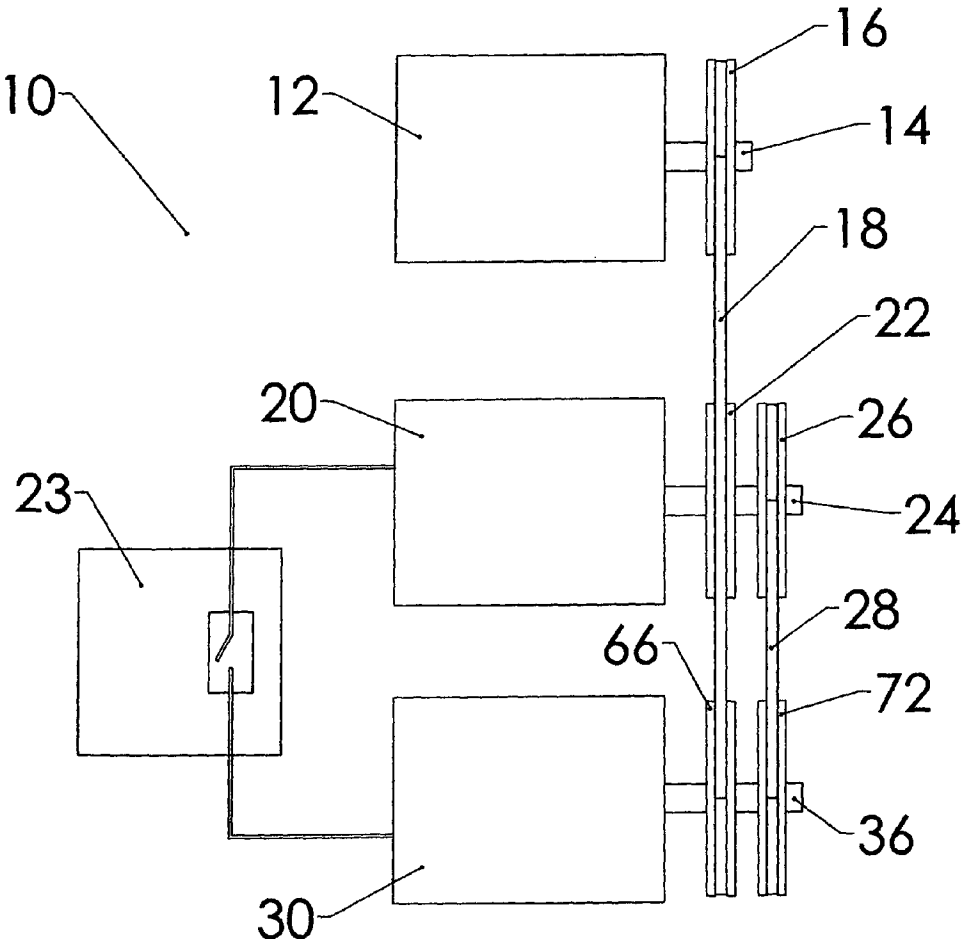
FIG. 1 is a schematic diagram detailing the relationship of the primary source, secondary source, and the compressor, according to the principles of the invention.

FIG. 1 is a schematic diagram showing the integral components of the inventive system 10. The system 10 will include a primary power source 12 configured to transmit torque to a drive disc 16 through a primary shaft 14. The primary source 12, commonly a diesel engine or standard automobile engine, will rotate a drive disc 16 in order to transmit rotating torque through first pulley belt 18 to a first sheave 22 that is mounted around a compressor shaft 24 of a standard air-conditioning compressor 20. A second sheave 26 is also mounted about the compressor shaft 24 and in very close proximity to the first sheave 22.

The compressor shaft 24 then transmits energy to the compressor, enabling the refrigeration system within the standard compressor to operate. An electrical switch 23 is in communication with a electrical clutch mechanism (discussed hereinafter) which will enable the compressor shaft 24 to be turned by either the first sheave 22 (when clutch is activated) or the second sheave 26 (when clutch is inactive).

Still referring FIG. 1, the system 10 will also include a secondary source 30 having a secondary shaft 36 configured to turn a drive disc 34, which transmits torque to the second sheave 26 by a second pulley 28. Typically, the secondary source can be any type of torque-producing motor, such as an electric motor, a small internal combustion engine, or even a motor/generator, as shown and discussed hereinafter.

In a first embodiment of the invention, the system 10 is well suited to have a secondary source 30 that operates from an auxiliary power source that is independent of the primary power source 12. When the secondary source 30 is independent of the primary power source 12, the system 10 enables operation of the air-conditioning compressor 20 without the primary power source 12.

Figure 2:
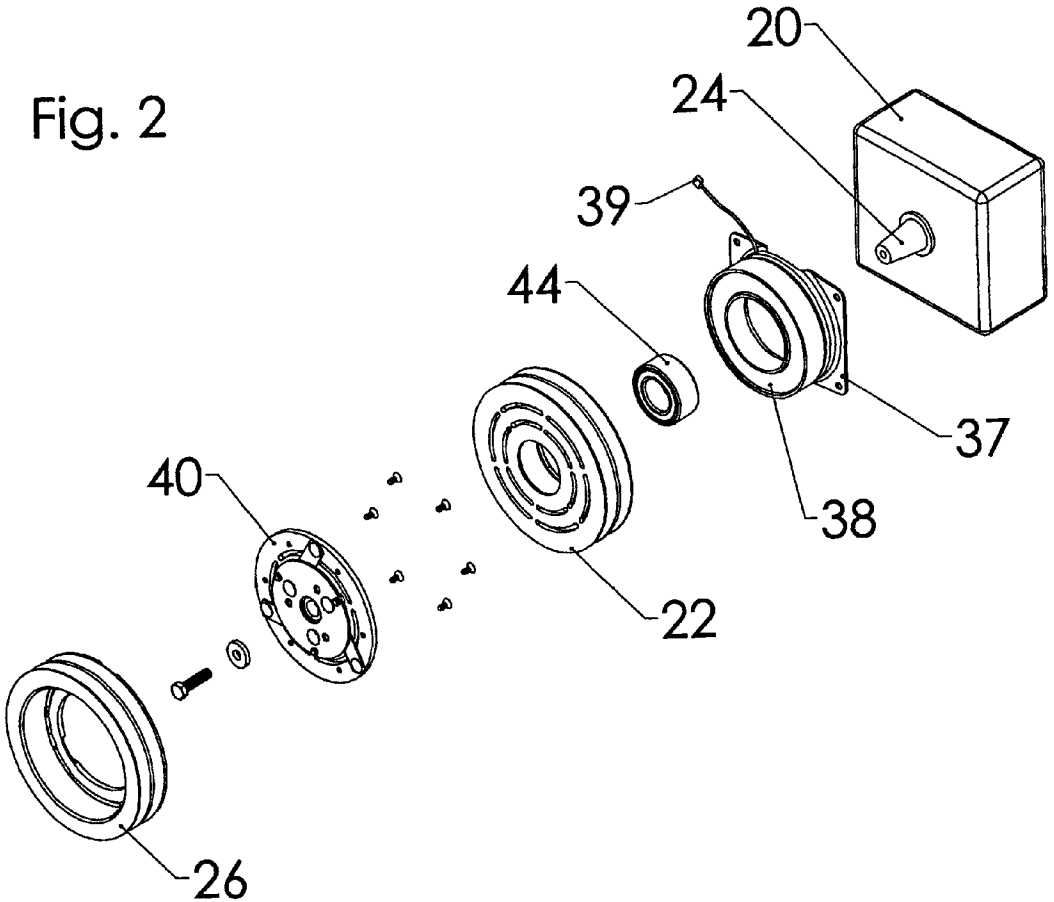
FIG. 2 is an exploded view isolating the components of the invention that are associated with the compressor.

FIG. 2 shows an exploded view isolating the parts of the compressor and a magnetic clutch mechanism. As shown, the compressor shaft 24 transmits torque to the compressor 20. A coil plate 37 is mounted to the compressor 20 and is connected by a cord 39 to the switch 23 (as in FIG. 1) that enables selective enactment of the first magnetic coil 38. As shown, the compressor shaft 24 passes through a hollow interior portion of the first magnetic coil 38. The first sheave 22 will also bear a hollow interior portion that envelops the outer portion of the first magnetic coil 38 to allow the first sheave 22 is mounted about the first magnetic coil 38 and is free to rotate relative the compressor shaft 24 and the first magnetic coil 38 that is integral with the coil plate 37 mounted directly to the compressor 20. The first sheave 22 may be mounted about the compressor shaft 24 using a hub bearing 44 that affixes the first sheave 22 to the compressor shaft 24, yet allows the first sheave 22 to spin. This configuration allows a relative rotation of the first sheave 22 about the compressor shaft 24 when the clutch (explained hereinafter) is in a de-energized state.

Still referring to FIG. 2, the inventive system will include a second sheave 26 bolted securely to a first clutch plate 40 that is coupled to the compressor shaft 24. Consequently, the first clutch plate 40 and second sheave 26 are affixed to the compressor shaft 24 to prevent relative rotation of the second sheave 26 with respect to the compressor shaft 24. Of course, the first clutch plate 40 and second sheave 26 may be integrally formed as a single, monolithic one-piece structure, even though depicted as distinct parts. In any regard, the best mode of the invention requires an absence of relative rotation between the compressor shaft 24 and the second sheave 26.

Figure 3:
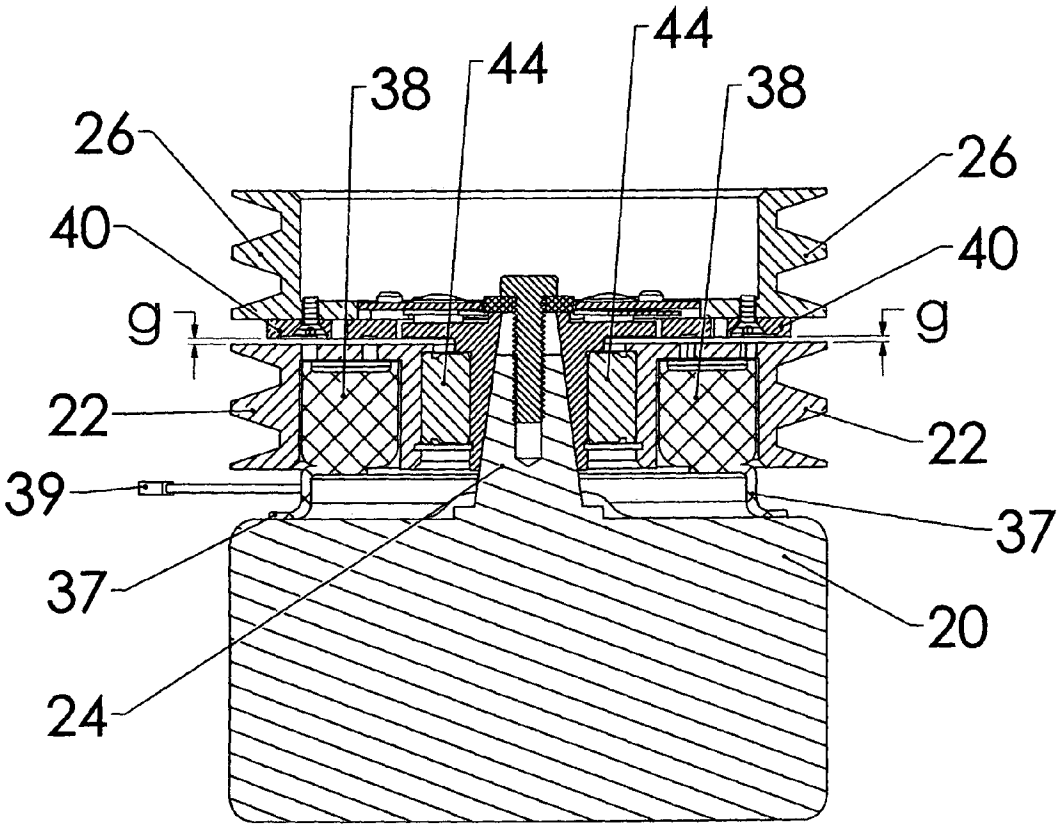
FIG. 3 is a cross-sectional view isolating the components of the invention that are associated with the compressor, shown with the first magnetic coil in a de-energized state.

FIG. 3 shows a cross sectional view detailing the spatial relationship of the first sheave 22 with the second sheave 26 when the first magnetic coil 38 is de-energized. As shown, the first sheave 22 is rotatably attached to the compressor shaft 24 by means of a bearing hub 44 that is mounted to the compressor shaft 24. The first magnetic coil 38 extends outwardly from the coil plate 37 and fits within a hollowed out portion of the first sheave 22. A cord 39 in communication with a switch (see FIG. 1) extends from the coil plate 37 in order to selectively energize the first magnetic coil 38.

Still referring to FIG. 3, the first clutch plate 40 is coupled to a face of the second sheave 26 and positioned such that a small gap g separates the first clutch plate 40 from the face of the first sheave 22. When the first magnetic coil 38 is in a de-energized state, a gap G separates the first clutch plate 40 of the second sheave 26 from the first sheave 22.

Still referring to FIG. 3, each of the first 22 and second sheaves 26 bear radial grooves to receive pulley belts (as shown in FIG. 1) for the transmission of rotating torques to the compressor. For example, the first sheave 22 will receive rotating torque from a first pulley belt 18 (FIG. 1) driven by the primary source 12 (as in FIG. 1); Conversely, the second sheave 26 will receive rotating torques from a second pulley belt 28 (FIG. 1) that engages the secondary source 30.

Figure 3A:
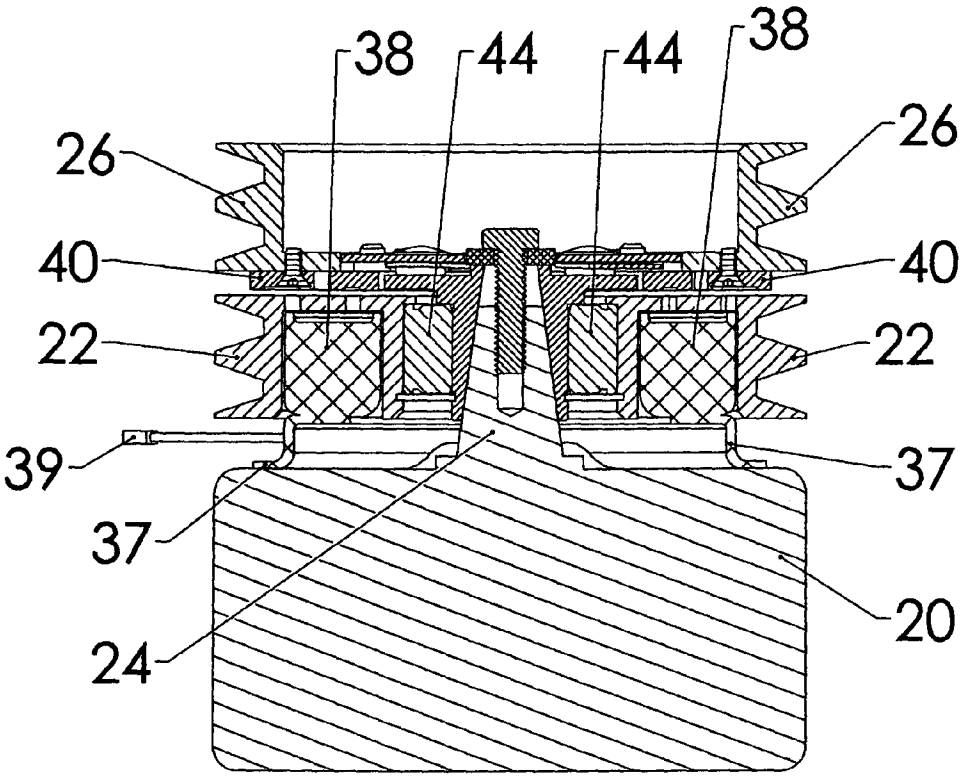
FIG. 3A is a cross-sectional view isolating the components of the invention that are associated with the compressor, shown with the first magnetic coil in an energized state.

FIG. 3A shows a cross sectional view detailing the spatial relationship of the first sheave 22 with the second sheave 26 when the first magnetic coil 38 is energized. A cord 39 in communication with a switch (see FIG. 1) extends from the coil plate 37 in order to selectively energize the first magnetic coil 38. When the first magnetic coil 38 is energized, the first clutch plate 40 of the second sheave 26 is pulled into contact first sheave 22, thereby eliminating the gap G separating the first 22 and second 26 sheaves. The frictional engagement of these parts (22,26) prevents relative movement of the first sheave 22 with respect to the second sheave 26. Consequently, when the first magnetic coil 38 is energized, the first sheave 22 and second sheave 26 will rotate together in unison. Because the second sheave 26 is coupled to the compressor shaft to inhibit relative rotation, energizing the first magnetic coil 38 will impart torque to the compressor 20 via the compressor shaft 24.

Figure 4:
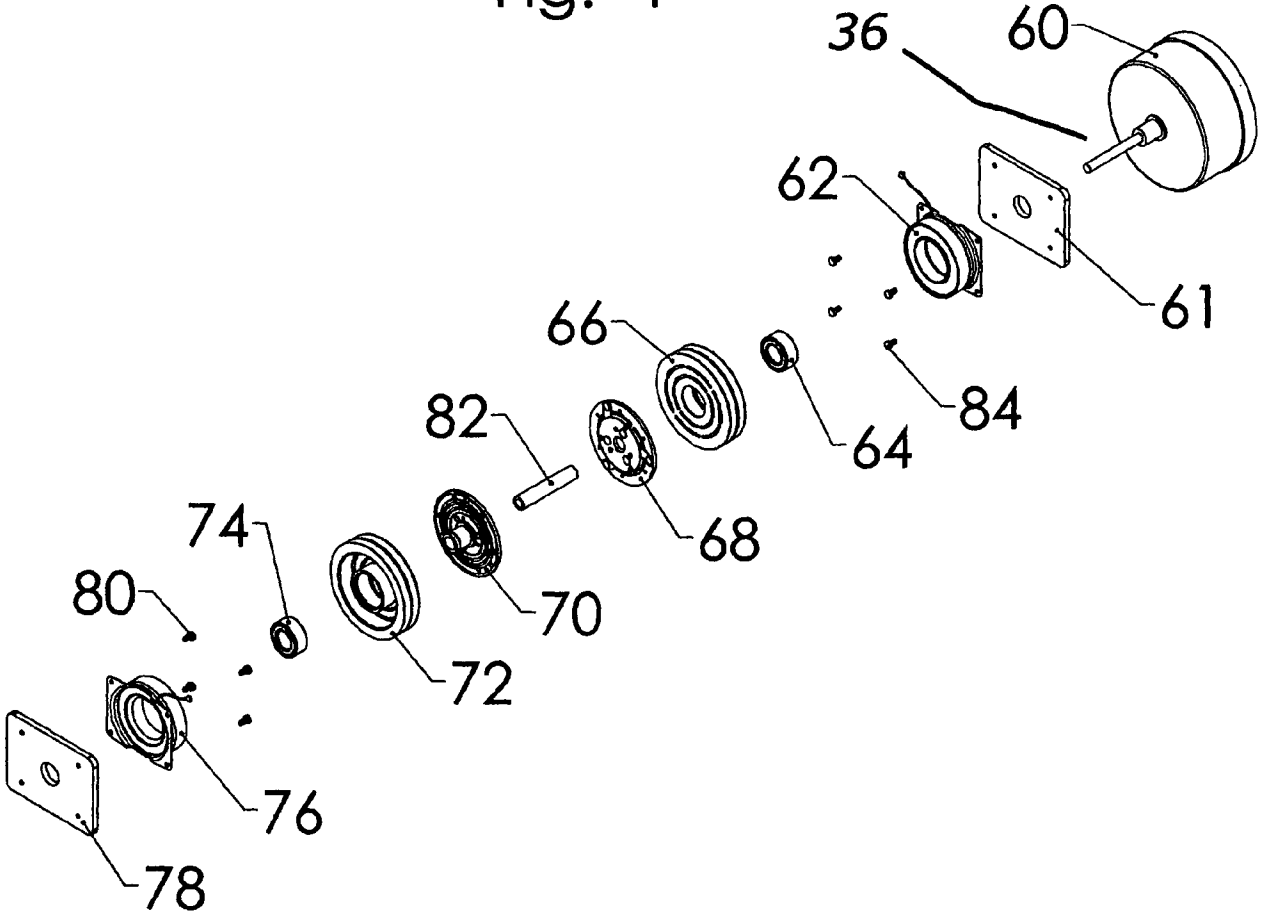
FIG. 4 is an exploded and perspective view isolating the components of the invention that are associated with the secondary source.

FIG. 4 shows an exploded and perspective view giving greater detail of the parts the secondary source 30 that is shown in FIG. 1. In this embodiment, the secondary source 30 (FIG. 1) is a motor generator 60 with a double magnetic clutch mechanism mounted to the secondary shaft 36. The attachment assembly bears a mounting plate 61 coupled to a second magnetic coil 62 by using a set of screws 84.

Still referring to FIG. 4, a first bearing hub 64 and a second bearing hub 74 are each mounted on a hollow clutch shaft 82, which is mounted over and affixed to the secondary shaft 36 of the motor generator 60. Each of these hubs 64, 74 allows relative rotation of its outer race with respect to its inner diameter. To wit, a third sheave 66 is coupled to the first hub 64 such that the third sheave 64 may rotate relative the hollow clutch shaft 82. In like manner, a fourth sheave 72 is coupled to the second bearing hub 74 such that the fourth sheave 72 is free to rotate relative the hollow clutch shaft 82.

A face of the third sheave 66 has an annular cavity formed to accommodate the annular shape of a second magnetic coil 62 that is coupled to the mounting plate 61. In like manner, a face of the fourth sheave 72 bears an annular cavity that is formed to accommodate the annular cavity of a third magnetic coil 76 that is affixed to a mounting plate 78 using a set of short screws 80. This distal mounting plate 78 may be affixed to the frame of the truck for stability. Alternatively, rods or screws (not shown) may pass from mounting plate 78 and affix to the mounting plate 61, thereby forming a cage that encloses and protects the sheaves 66,72 that are affixed to the hollow clutch shaft 82.

Still referring to FIG. 4, a pair of clutch plates 68,70 are coupled about the shaft 82 to prevent relative rotation of each plate 68,70 relative the secondary shaft 36. A second clutch plate 68 is positioned adjacent the third sheave 64 such that a small gap or clearance exists between the face of the second clutch plate 68 and a face of the third sheave 64. Analogously, a third clutch plate 70 is affixed to the hollow clutch shaft 82 and positioned adjacent the fourth sheave 72 such that a small void separates the face of the third clutch plate 70 and the fourth sheave 72.

Figure 5:
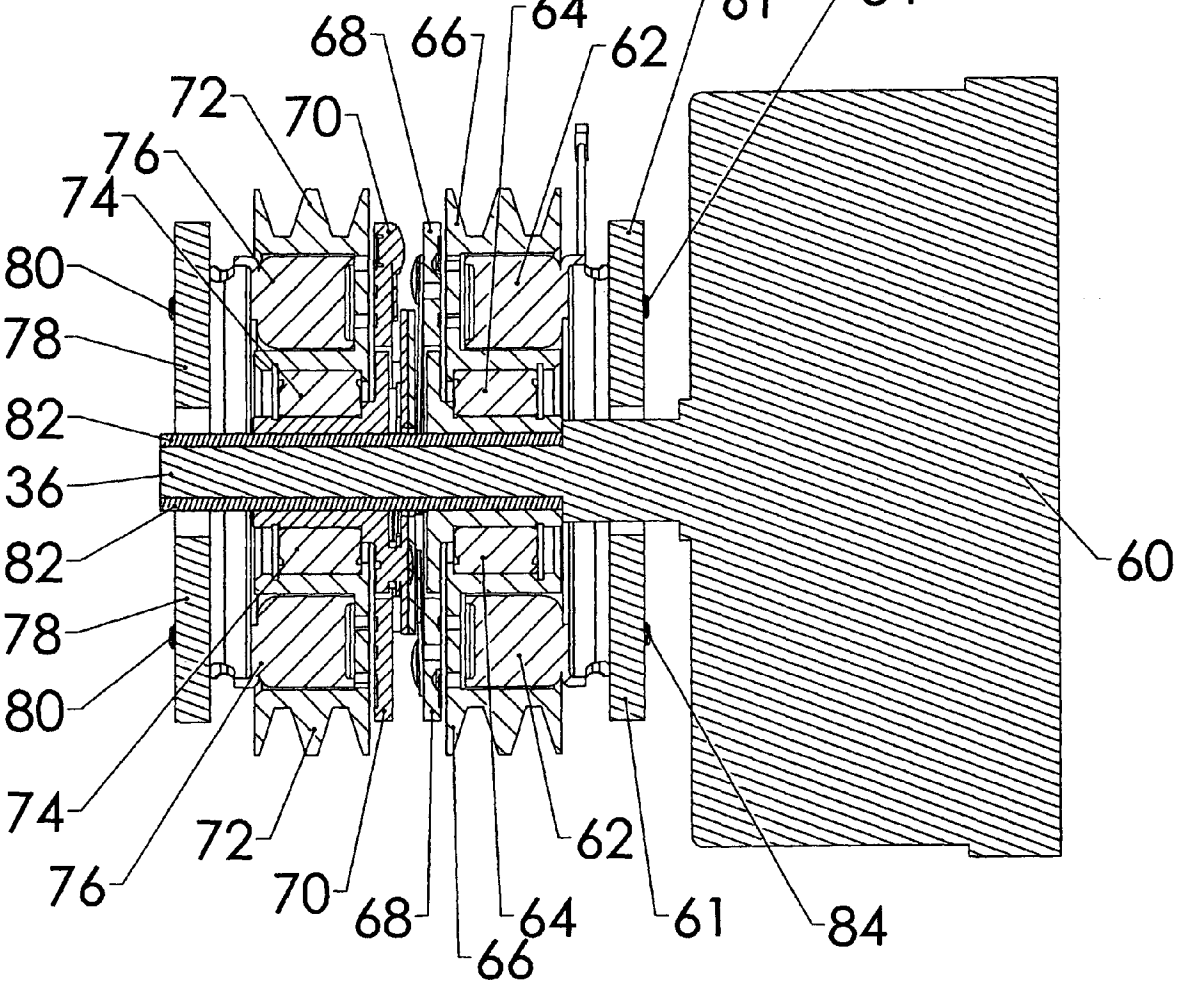
FIG. 5 is a cross-sectional view isolating the components of the invention that are associated with the secondary source.

FIG. 5 shows a cross-sectional view of the attachment assembly that is shown in FIG. 4. As shown in FIG. 5, the secondary source is 30 (see FIG. 1) includes a motor/generator 60 having a mounting plate 61 coupled to it by screws 84 that affix the mounting plate 61 to the second magnetic coil 62. The secondary shaft 36 passes through the circular void of the second magnetic coil 62 and it mounting plate 61. The respective bearing hubs 64,74 of the sheaves 66,72 are each mounted to the shaft 82 to allow relative rotation of each sheave 66,72 with respect to the secondary shaft 36.

FIG. 5 shows a cross-sectional view of the attachment assembly that is shown in FIG. 4. As shown in FIG. 5, the secondary source is 30 (see FIG. 1) includes a motor/generator 60 having a mounting plate 61 coupled to it by screws 84 that affix the mounting plate 61 to the second magnetic coil 62. The secondary shaft 36, shown in FIG. 5 as the driving shaft of the motor generator 60 passes through the circular void of the second magnetic coil 62 and its mounting plate 61. The respective bearing hubs 64,74 of the sheaves 66,72 are each mounted to the secondary shaft 36 by means of a hollow clutch shaft 82 to allow relative rotation of each sheave 66,72 with respect to the secondary shaft 36.

Still referring to FIG. 5, a second magnetic coil 62 is mounted to the mounting plate 61 such that it is received within the annular ring formed within the third sheave 66. In like manner, a third magnetic coil 76 is mounted (by means of screws 80) to a plate 78 such that the third magnetic coil 76 is received within the annular ring within the fourth sheave 72.

As in FIG. 5, second clutch plate 68 is affixed to the secondary shaft 36 and is positioned thereon such that a small gap g separates the second clutch plate 68 from the third sheave 66. This small gap g is present when the second magnetic coil 62 is in a de-energized state. When the second coil 62 is energized, however, the magnetic field induced by the second magnetic coil 62 pulls the second clutch plate 68 into frictional engagement with the third sheave 66, compelling the second clutch plate 68 and the third sheave 66 to rotate together with the secondary shaft 36. Consequently, energizing the second magnetic coil 62 restricts rotation of the third sheave 66 relative the secondary shaft 36, forcing the third sheave 66 and the secondary shaft 36 to rotate in unison. As such, energizing the second magnetic coil 62 enables torques to be transmitted to and from the secondary shaft 36 via the third sheave 66.

Still referring to FIG. 5, a third clutch plate 70 is mounted and affixed to the hollow clutch shaft 82, which is affixed to the motor generator shaft 36 to prevent rotation of the third clutch plate 70 relative the shaft 36. The third clutch plate is positioned such that a small gap g separates the third clutch plate 70 from the fourth sheave 72. This small gap is present when secondary coil 76 is in a de-energized state. When the third coil 76 is energized, however, the induced magnetic field pulls the third clutch plate 70 into frictional engagement with the fourth sheave 72, compelling the third clutch plate 70 and the fourth sheave 72 to rotate together with the shaft 36. Consequently, energizing the second coil 76 restricts relative rotation of the secondary sheave 72 and the shaft 36, thereby enabling the transfer of rotating torques to and from the shaft 36 via a pulley belt in combination with the fourth sheave 72.

In order to understand the workings of the system 10, it will be helpful to juxtapose FIGS. 1 and 5 and view the two simultaneously. Viewing FIG. 5 and FIG. 1 together, the fourth sheave bears a pulley belt 28 that also engages the second sheave 26 that is affixed to the compressor shaft 24. When the primary source 12 (of FIG. 1) is not running, the motor generator 60 will drive the compressor 29 (FIG. 1) by imparting rotating torque from fourth sheave 72, through pulley belt 28, and to the second sheave 26, which of course will turn the compressor shaft 24.

Still referring to FIGS. 5 and 1 together, when the primary source 12 (FIG. 1) is running, however, the compressor 20 (FIG. 1) is driven by the primary source 12 (FIG. 1) by a first pulley belt 18 (FIG. 1) that passes from the primary source 12 (FIG. 1), and engages the first sheave 22 (FIG. 5), which imparts rotation to the compressor shaft 24 (FIG. 5).

Still referring to FIGS. 1 and 5 together, the first pulley belt 18 that transmits torque from the primary source to the compressor 20 also engages the third sheave 66, which is affixed to the secondary shaft 36 (FIG. 5). Thus, energizing the second magnetic coil 62 (FIG. 5) enables rotating torque to be transmitted from the primary source 12 (FIG. 1) to the secondary source 30 (FIG. 1) shown in FIG. 5 to be a motor generator 60. When this occurs, rotating torque is RECEIVED by the motor generator 60; in this instance, the motor generator 60 captures and stores electromotive energy that can operate the electrical system. In a preferred embodiment, a motor generator 60 of this invention can replace the standard alternator/generator of the known internal combustion arrangement.

Having described in detail the invention, it is to be understood that this description is for illustrative purposes only. The scope of the invention shall be limited only by claims which precisely set forth and metes and bounds of the invention.

The invention claimed is:

1. A system for operating an air conditioning compressor from alternative sources, the system comprising:

an air conditioning compressor having a compressor shaft;

a primary source;

a secondary source including a motor generator having a motor generator shaft;

a double magnetic clutch mounted to the motor generator shaft, the double magnetic clutch being selectively operable between a driving condition such that the motor generator shaft imparts torque to the air conditioning compressor and a driven condition such that the primary source imparts torque to the motor generator;

a first magnetic coil mounted to the compressor and encircling the compressor shaft;

a means for energizing the first magnetic coil, thereby emitting a magnetic field from the first magnetic coil;

a first sheave rotatably mounted to the compressor shaft to enable rotation of the first sheave relative the compressor shaft;

a second sheave affixed to the compressor shaft to restrict rotation of the second sheave relative the compressor shaft, the second sheave having a first clutch plate coupled to its face; and, a first pulley belt configured to transmit rotation from the primary source to the first sheave;

a second pulley belt configured to transmit rotation from the secondary source to the second sheave;

a deformable gap separating the first sheave from the first clutch plate when the coil is in a de-energized state;

wherein, when the first magnetic coil is energized, an induced magnetic field biases the first sheave into frictional engagement with the first clutch plate, thereby restricting rotation of the first sheave relative the compressor shaft.

2. The system as in claim 1, the double magnetic clutch comprising a second magnetic coil affixed adjacent the generator motor such that the motor generator shaft passes through a center void of the second magnetic coil;

a third magnetic coil positioned adjacent a terminal end of the motor generator shaft;

a second clutch plate coupled to the motor generator shaft;

a third sheave rotatably mounted to the motor generator shaft and having a hollow cooperatively formed with the second magnetic coil such that the third sheave extends over and envelops the second magnetic coil; the second clutch plate positioned adjacent a face of the third sheave but separated therefrom by a small gap when the first magnetic coil is an a deenergized state;

a third clutch plate coupled to the motor generator shaft;

a fourth sheave rotatably mounted to the motor generator shaft and having a hollow cooperatively formed with the third magnetic coil such that the fourth sheave extends over and envelops the third magnetic coil; the third clutch plate positioned adjacent a face of the fourth sheave but separated therefrom by a small void when the third magnetic coil is in a deenergized state;

wherein, energizing the second magnetic coil induces a magnetic field that pulls the third sheave into frictional engagement with the second clutch plate, thereby restricting relative rotation of the third sheave relative the motor generator shaft when the second magnetic coil is in an energized condition; and wherein, energizing the third magnetic coil induces an electromagnetic force that pulls that the third clutch plate into frictional engagement with the fourth sheave, thereby restricting rotation of the fourth sheave relative the motor generator shaft when the third magnetic coil is in an energized condition.

3. The system as in claim 1, further comprising a first pulley belt for transmitting rotating torques from the primary source to the compressor shaft;

a second pulley belt for transferring rotating torque between the secondary source and the compressor.

4. The system as in claim 3, further comprising a third sheave rotatably mounted about the motor generator shaft;

a fourth sheave rotatably mounted about the motor generator shaft; wherein, the first pulley belt engages the first sheave; and the second pulley belt engages the second sheave and the fourth sheave.

5. The system as in claim 4, wherein the first pulley belt further engages the third sheave.

6. The system as in claim 1, wherein the primary source includes an internal combustion engine.

7. The system as in claim 6, wherein the primary source includes an auxiliary shaft of a diesel engine.

8. The system as in claim 1, wherein the secondary source includes an electric motor.

9. The system as in claim 1, further including:

a current source in electric communication with the first magnetic coil; and a switch for enabling the current source to selectively induce a magnetic field.

10. A system for operating an air conditioning compressor from alternative sources, the system comprising:

a primary source;

a secondary source including a motor generator having a motor generator shaft;

an air conditioning compressor having a rotatable input compressor shaft;

a first magnetic coil affixed adjacent the compressor and encircling the compressor shaft;

a means for inducing current within the first magnetic coil, thereby creating an energized state whereby a magnetic field is emitted from the first magnetic coil;

a first sheave rotatably mounted about the compressor shaft to enable rotation of the first sheave relative the compressor shaft;

a second sheave having a face comprising a first clutch plate, the second sheave affixed to the compressor shaft;

a first pulley configured to transmit rotations between the primary source and the first sheave;

a second pulley configured to transmit rotations between the secondary source and the second sheave;

a deformable gap separating the face of the second sheave from the first sheave when the first magnetic coil is in a de-energized state;

a second magnetic coil affixed adjacent a face of the motor generator such that the motor generator shaft passes through a center void of the second magnetic coil;

a third magnetic coil affixed adjacent a terminal end of the motor generator shaft;

a second clutch plate coupled to the motor generator shaft;

a third sheave rotatably mounted to the motor generator shaft and having a hollow cooperatively formed with the second magnetic coil such that the third sheave extends over and envelops the second magnetic coil; the second clutch plate positioned adjacent a face of the third sheave but separated therefrom by a small gap when the second magnetic coil is an a deenergized state;

a third clutch plate coupled to the motor generator shaft;

a fourth sheave rotatably mounted to the motor generator shaft and having a hollow cooperatively formed with the third magnetic coil such that the fourth sheave extends over and envelops the third magnetic coil; the third clutch plate positioned adjacent a face of the fourth sheave but separated therefrom by a small void when the third magnetic coil is in a deenergized state;

wherein, when the first magnetic coil is energized, an induced magnetic field biases the first clutch plate into frictional engagement with the first sheave to impart rotating torque to the compressor shaft;

and wherein, energizing the second magnetic coil induces a magnetic field that pulls the second clutch plate into frictional engagement with the third sheave, thereby restricting relative rotation of the fourth sheave relative the motor generator shaft when the primary magnetic coil is in an energized condition; and, and wherein, energizing the third magnetic coil induces an electromagnetic force that pulls that the third clutch plate into frictional engagement with the fourth sheave, thereby restricting relative rotation of the fourth sheave relative the motor generator shaft when the third magnetic coil is in an energized condition.

11. The system as in claim 10, further including first pulley belt configured to transmit rotation between the primary source and the compressor;

a second pulley belt configured to transmit rotation between the secondary source and the compressor.

12. The system as in claim 11, wherein the first pulley belt engages the first sheave, and the second pulley belt engages the second sheave.

13. The system as in claim 11, wherein the first pulley belt engages the third sheave.

* * * * *